United States Patent [19]

Copeland et al.

[11] 4,429,432

[45] Feb. 7, 1984

[54] SANITIZER ATTACHMENT FOR A MOBILE FLOOR CLEANER

[75] Inventors: William M. Copeland, Hoffman Estates; Roland A. Blomgren, Glen Ellyn; Robert L. Shallenberg, Wheaton, all of Ill.

[73] Assignee: ServiceMaster Industries, Inc., Downers Grove, Ill.

[21] Appl. No.: 266,798

[22] Filed: May 26, 1981

[51] Int. Cl.[3] ..... A47L 9/00

[52] U.S. Cl. ..... 15/320; 15/257 B; 15/339; 15/347

[58] Field of Search ..... 15/257 B, 320, 347, 15/339, 50 R

[56] References Cited

U.S. PATENT DOCUMENTS

| | | | |
|---|---|---|---|
| 1,527,224 | 2/1925 | Riordan | 15/257 B |
| 1,726,741 | 9/1929 | Keller | 15/257 B |
| 1,764,439 | 6/1930 | Fuhrmann | 15/320 X |
| 3,296,777 | 1/1967 | Jackson et al. | 15/339 X |
| 3,600,100 | 8/1971 | Arones | 15/50 R X |

*Primary Examiner*—Chris K. Moore

*Attorney, Agent, or Firm*—Allegretti, Newitt, Witcoff & McAndrews, Ltd.

[57] ABSTRACT

An improved apparatus for spraying a fluid or fluid and gas mixture behind and substantially in the path of a mobile floor cleaner. An attachment housing is attached to the mobile floor cleaner, and at least one spray nozzle is positioned in the housing to generate a fluid or fluid and gas spray. Fluid is supplied to the spray nozzle by a fluid reservoir that is attached to the housing and connected to the spray nozzle by means of a fluid line.

10 Claims, 8 Drawing Figures

20
12
34
43
36
54
37
10
47
52
18
64
38
80
40
96
48
65
60
14
63
36
16
34
66
22
12
47
62
23
25
46
28
24
32
58
44

20
60
42
14
65
36
52
67
16
10
69
22
62
10
91
18
28
90
92
24
38
58
40
44
99

SANITIZER ATTACHMENT FOR A MOBILE FLOOR CLEANER

BACKGROUND OF THE INVENTION

This invention relates to an improved mobile floor cleaner, such as might be used to sanitize and sweep or vacuum a rug or other floor surface. More particularly, this invention relates to a sanitizer attachment that sprays a fluid or fluid and gas spray behind and into the path of movement of a mobile floor cleaner to which it is either fixedly or removably attached.

In the prior floor cleaning art, it has long been a practice to (1) sweep or vacuum a floor or floor-like surface and and then, during another separate step, (2) spray the surface with a fluid or fluid and gas spray. The spray is then left to dry on the surface, and the remnant, if any, is not removed until later—perhaps during the next floor cleaning operation, when the surface is again (1) swept or vacuumed and then (2) sprayed.

The second fluid or fluid and gas spraying step may serve many diverse functions. For example, it can serve to disinfect the surface, or it can work as an agent for debris removal from the surface during the next cleaning, sweeping, or vaccuming operation. Both objectives are achieved by spraying SaniMaster Solution, a product of ServiceMaster Industries, Inc., on the surface during the second spraying step noted above.

In the prior art, however, it has also long been a practice to clean or sanitize a rug or other floor or floor-like surface in one step by first spraying a fluid or fluid and gas mixture onto the surface and immediately thereafter removing the fluid from the surface by means of a vacuum or other debris and fluid removing device attached to the spraying mechanism. Since such spraying and fluid and debris removing devices are attached to each other, such devices allow for one-step spraying and subsequent fluid and debris removal from the surface.

As noted above, however, it is sometimes desirable to reverse the sequence of such one step procedures—to first sweep or vacuum a surface and then spray the surface with a fluid or fluid and gas mixture, leaving the spray to dry on or in the surface and remain there until later removal of the dried remnant during a subsequent cleaning, sweeping or vacuuming operation. The one-step devices in the prior art described above cannot provide for a one-step method of first sweeping or vacuuming a surface and then spraying the surface with a fluid or fluid and gas spray, which is left to dry on the surface. Yet the methods in the prior art for first sweeping or vacuuming and then spraying a floor or floor-like surface are all two-step processes, which are cumbersome and time consuming. Hence, it is an object of the instant invention to attempt to reduce the inefficiency of such two step processes by providing an apparatus for first sweeping or vacuuming a surface and then spraying the surface with a fluid or fluid and gas spray—all in one step.

There are also devices in the prior art, such as the ServiceMaster BOVAC hospital carpet vacuum, that have a plurality of air filters and debris catching hoppers removably attached to them. Though such devices do sweep or vacuum the rug or other floor or floor-like surfaces over which they pass, they have no capability for spraying a fluid or fluid and gas mixture onto the surface. Thus, it is also an object of this invention to provide an attachment that will spray a fluid or fluid and gas spray behind the path of travel of such prior art devices. Another object is to create a spraying attachment that will removably attach in place of one or more filters or hoppers in devices such as the ServiceMaster BOVAC hospital carpet vacuum. An even further object is to provide for devices like the BOVAC hospital carpet vacuum a filter replacing spraying attachment that will also serve a filtering function and, where necessary, pass the air to be filtered to any further filters contained within the floor cleaning device.

Lastly, sweeping or vacuum cleaners in the prior art, such as the ServiceMaster BOVAC hospital carpet vacuum, are also sometimes self-propelled. Such self-propelled devices will move the cleaner when a switch or handle is thrown, pushed, or pulled one way and will stop moving the cleaner when the switch or handle is thrown, pushed, or pulled in another direction. It is therefore yet another object of this invention to provide a sanitizer attachment for such self-propelled cleaners that will automatically start spraying when the cleaner moves and stop spraying when the cleaner stops moving.

There are other purposes and objects of the present invention. They will appear as the specification proceeds.

SUMMARY OF THE INVENTION

The foregoing objects are accomplished by my invention of an improved mobile floor cleaner. The improvement comprises of an apparatus for spraying a fluid or fluid and gas mixture behind and substantially in the path of the cleaner. The improvement includes a housing attached to the cleaner and at least one nozzle positioned in the housing for generating a fluid or fluid and gas spray. The improvement also includes a fluid reservoir that is attached to the housing and connected to the nozzle by means of a fluid line.

BRIEF DESCRIPTION OF THE DRAWINGS

In the accompanying drawings, one particular embodiment of the present invention is illustrated wherein.

DETAILED DESCRIPTION OF THE PREFERRED EMBODIMENT

Figure 1:
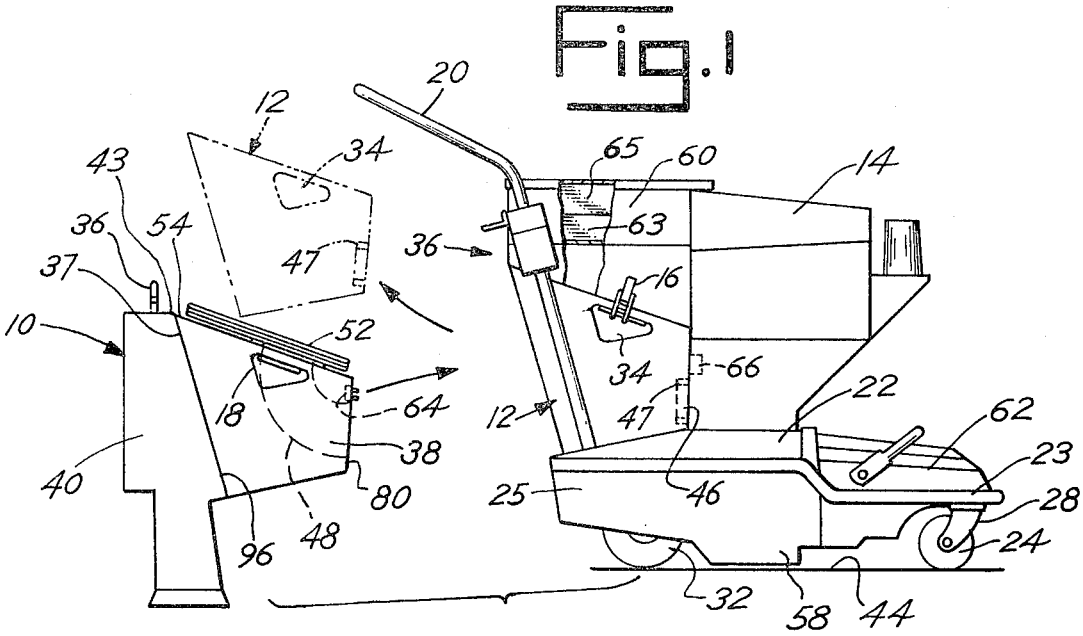
FIG. 1 is a side plan view of a self-propelled, battery operated hospital carpet vacuum and a removable spraying attachment that is insertable in place of a removable dust hopper in the carpet vacuum.

Referring to FIG. 1, the preferred embodiment of the sanitizer attachment, generally 10, is designed to mount in place of a dust hopper 12 in a ServiceMaster BOVAC hospital carpet vacuum, generally 14. The ServiceMaster BOVAC hospital carpet vacuum 14 is a self-propelled, battery powered vacuum cleaner that is steered by means of a handle 20 extending upward from the rear of the base 22 of the carpet vacuum 14. Two steerable front wheels 24 and 26 (26 not shown) are mounted in rotatable casters 28 and 30 (30 not shown) extending downwardly from the front portion 23 of the base 22. The rear portion 25 of the base 22 is movably supported by a drive wheel 32 that automatically moves the carpet vacuum 14 when the handle 20 is pushed downward toward the base 22 by the operator.

Figure 2:
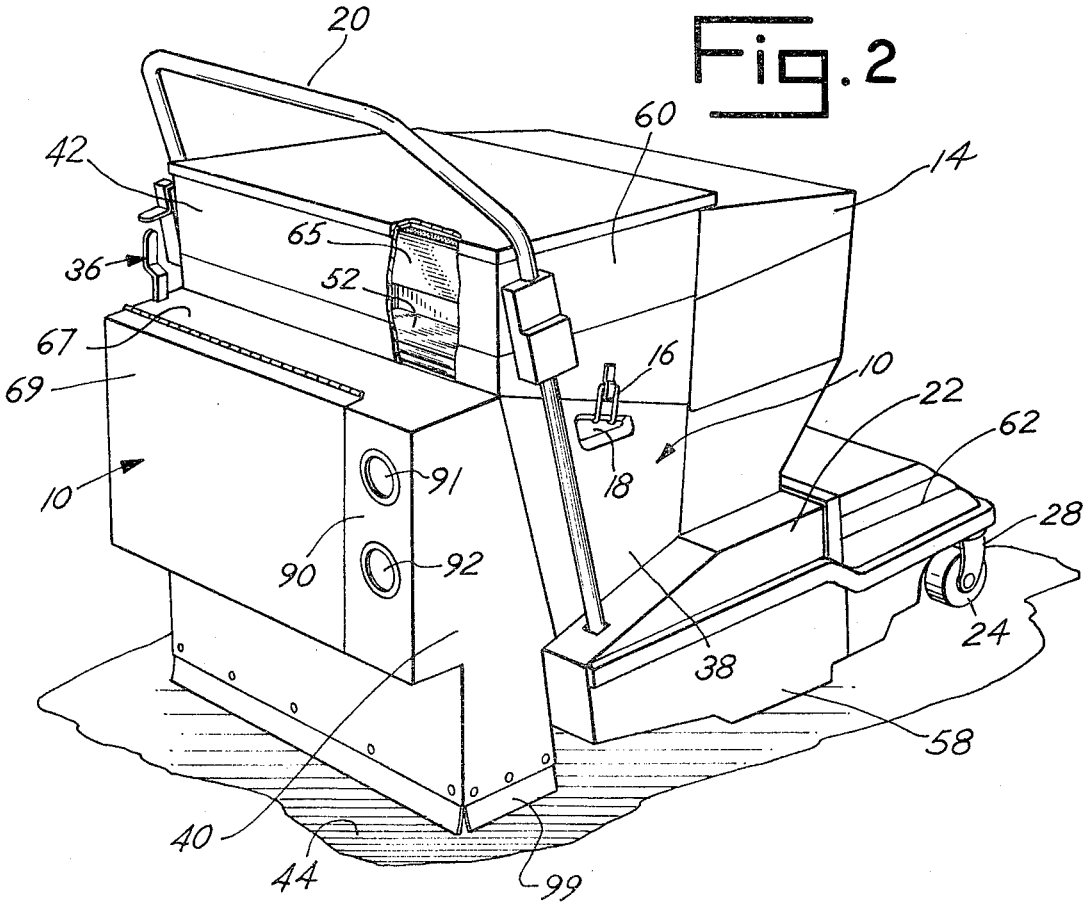
FIG. 2 is a perspective view of an improved hospital carpet vacuum with a removable spraying attachment mounted in place of a removable dust hopper in a self-propelled, battery operated hospital carpet vacuum.

Referring still to FIG. 1, extending downwardly from the base 22 between the drive wheel 32 and the front wheels 24 and 26 (not shown) is the debris removing portion 58 which removes smaller debris from a carpeted surface via an air stream that travels, when the hopper 12 is in place, from the air channel 46 in the carpet vacuum 14 first through a hopper air receptacle 47 in the dust hopper 12 and then through the first 63 and second 65 removable dust filters within the filter housing 60 immediately above the hopper 12. As shown in FIG. 2, when the hopper 12 and the first filter 63 are removed from the carpet vacuum 14 and the attachment 10, with inflatable filter bag 52, is inserted into the place of the hopper 12 so that the filter bag 52 enters the filter housing 60, the air stream from the debris removing portion 58 travels through the attachment 10 to the filter bag 52, which is air and small-particulate dust permeable, and then to the second filter 65. Referring back to FIG. 1, regardless of whether the hopper 12 or attachment 10 is in place, certain types of larger debris are not removed from the surface via the air stream but are instead swept into a forward hopper 62 in the base 22 of the vacuum cleaner 14 by a sweeper (not shown) in the debris removing portion 58.

The sanitizer attachment 10 has essentially two major, separable portions 38 and 40 and the filter bag 52. When the two portions 38 and 40 are assembled into a unit, the first, hopper-like portion 38 has outer dimensions that are essentially identical to those of the dust hopper 12 except for the two protruding prongs of the power plug 64 in the forward-most side 80 of the hopper-like portion 38. The filter bag 52 is mounted on the upper face 54 of the hopper-like portion 38 and has outer dimensions such that it can insert into the filter housing 60 and fully inflate therein when the first filter 63 is removed from the housing 60. The second, rearwardly extending portion 40 extends horizontally about five inches from the uppermost back edge 43 on the back side 37 of the hopper-like portion 38 and extends from the uppermost edge 43 the hopper-like portion's back side 37 about two feet vertically downward in order to touch the surface of the floor 44 when mounted on the carpet vacuum 14 shown in FIG. 2.

Figure 4:
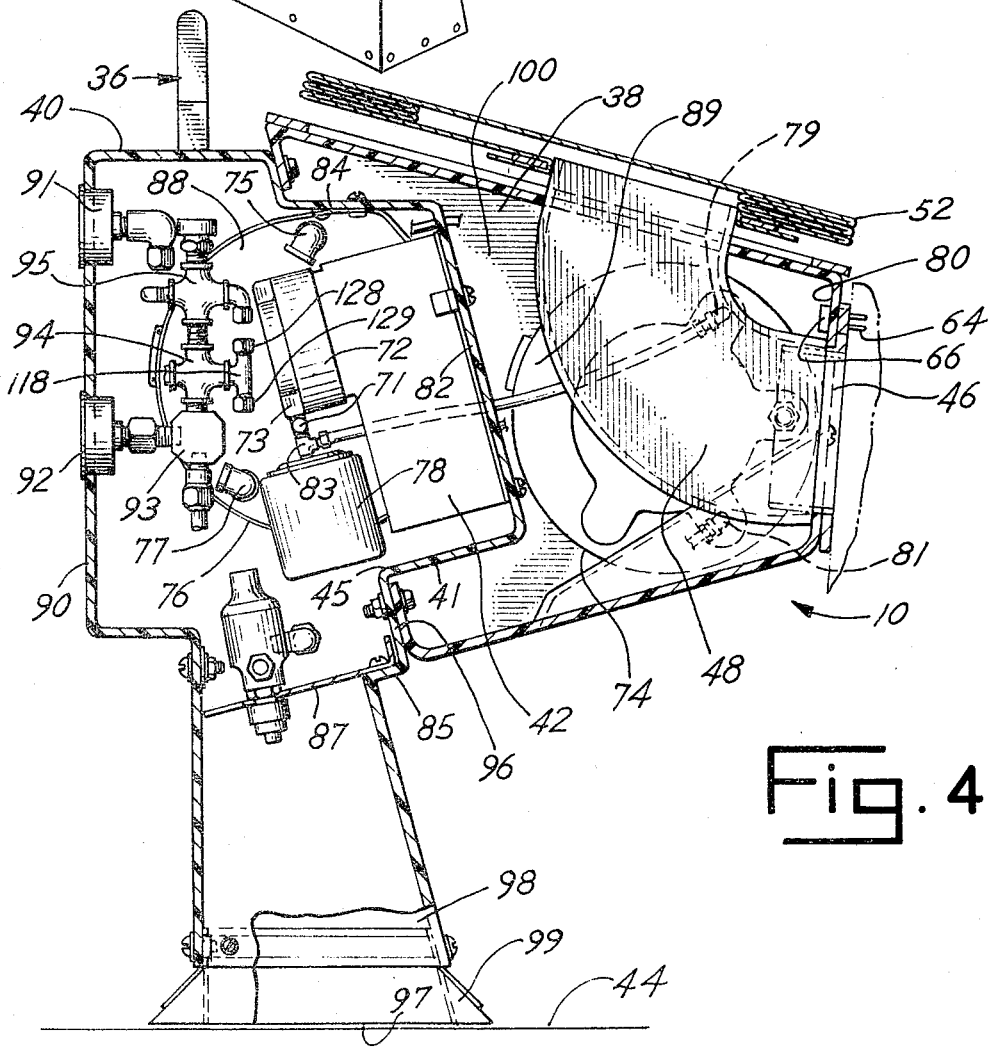
FIG. 4 is a detailed cross-sectional side plan view of a fluid spraying attachment taken along section line 4—4 as shown in FIG. 3.

With reference to FIG. 4, the second, rearwardly extending portion 40 also has a somewhat rectangular protrusion 41 that extends from the front side edge 96 of the second portion 40 about four inches into the internal space of the hopper-like portion 38. Extending downward on the second portion 40, from about three inches below the lowermost horizontal edge 45 of the protrusion 41 to about one inch above the surface of the carpet 44, is the shroud 98, and attached to the periphery of the lowermost edge of the shroud 98 is a rubber skirt 99 that extends all the way to and touches the surface of the carpet 44.

Referring back to FIG. 1, in order to remove the dust hopper 12 from the BOVAC hospital carpet vacuum 14, the right latch 16 gripping the upper edge of the recessed handle 34 in the right side of the hopper 12 is thrown open. The same is done with the left latch (not shown) on the left sides (not shown) of the carpet vacuum 14 and hopper 12. The hopper 12 is then removed from the carpet vacuum 14, and, as shown in FIG. 2, the hopper-like portion 38 of the sanitizer attachment 10, along with the filter bag 52 mounted thereon, is inserted into the position in the carpet vacuum 14 formerly occupied by the dust hopper 12. Referring back to FIG. 1, the filter bag 52 thus enters the filter housing 60 above the hopper-like portion 38 of the attachment 10, the power plug 64 on the attachment 10 mates with the power-supplying plug receptacle 66 on the carpet vacuum 14, and an air-receiving plastic elbow 48 in the hopper-like portion 38 mates with the air channel 46 on the carpet vacuum 14. As shown in FIG. 2 for the right side of carpet vacuum 14 and sanitizer attachment 10, the latch 16 is then closed in such a manner that the upper edge of the recessed handle 18 on the right side of the attachment 10 is firmly grasped by the latch 16 to hold the right side of the sanitizer 10 in place on the carpet vacuum 14. The same is done with the left latch (not shown) on the left side (not shown) of the carpet vacuum 14 and attachment 10.

Referring still to FIG. 2, a hinged door 69 is mounted in the left rear 90 and top 67 sides of the second, rearwardly extending portion 40 of the attachment 10. The door 69 allows the operator unhampered access to the inside of the second portion 40 of the attachment 10.

To the right of the hinged door 69 on the rear side 90 of the second portion 40, two pressure gauges 91 and 92 are mounted one 91 vertically above the other 92. The gauges 91 and 92 allow the operator to read the gas pressures in several later-described components within the attachment 10.

Figure 3:
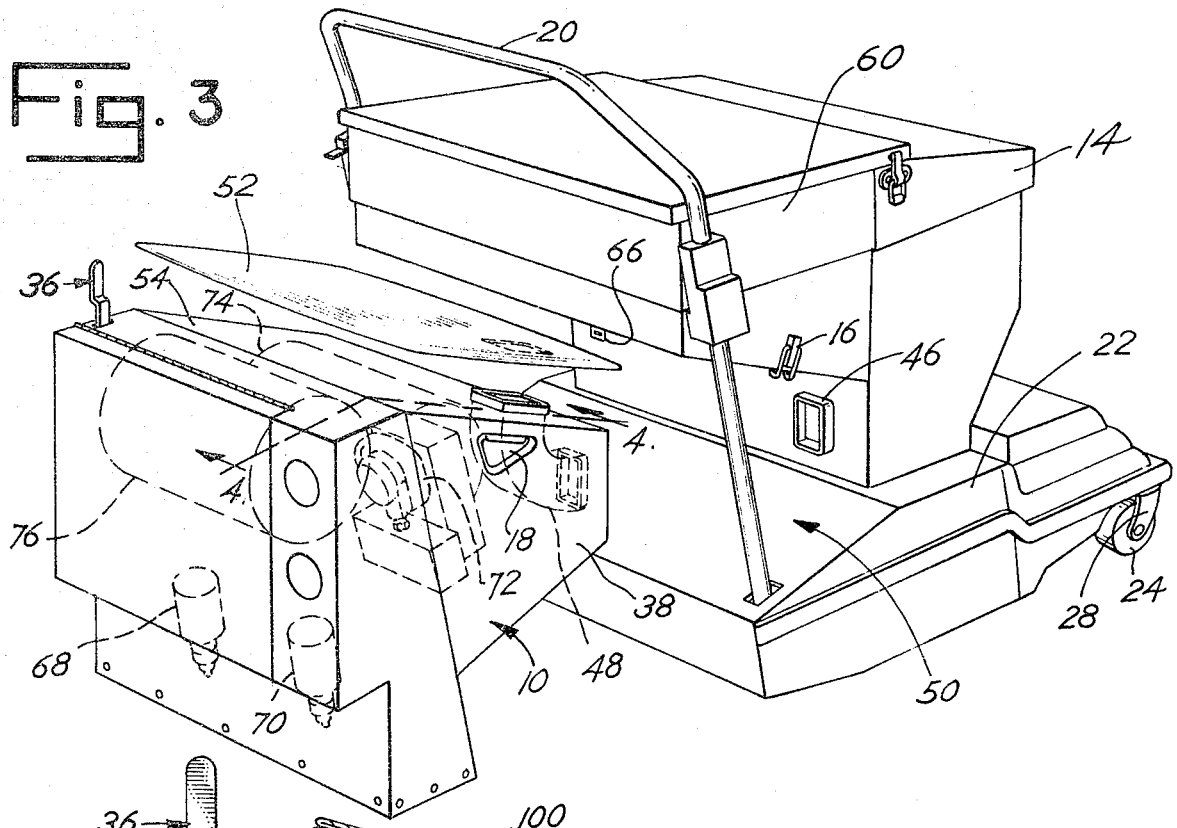
FIG. 3 is an exploded perspective view of an improved hospital vacuum apparatus showing the location of the spray nozzles, the fluid reservoir, the gas source, and the air stream receiving and delivering system within a removed spraying attachment.

Referring now to FIG. 3, when the attachment 10 is mounted on the carpet vacuum 14 as noted above, the hollow plastic elbow 48 in the hopper-like portion 38 of the sanitizer attachment 10 engages the rearwardly protruding air channel 46 in the hopper receptacle portion, generally 50, of the vacuum cleaner 14. The elbow 48 directs exhaust air from the debris removing portion 58 (not shown in FIG. 3) of the carpet vacuum 14 into the filter bag 52 on the uppermost face 54 of the hopper-like portion 38 of the sanitizer attachment 10. The elbow 48 passes through the uppermost face 54 of the attachment 10 to deliver the exhaust air to the filter bag 52, which, in turn, passes the exhaust air and smaller particles of debris to the second filter 65 mounted in the filter housing 60 in the carpet vacuum 14.

The preferred embodiment of the sanitizer attachment 10 also contains two spray nozzles 68 and 70 for spraying a sanitizing fluid and gas spray behind and in the path of travel of the carpet vacuum 14. The spray is controllably generated by means of an air compressor 72, a compressed air tank 74, a fluid reservoir 76, and a pressure switch 78, all of which are also contained within the confines of the sanitizer attachment 10.

Referring once again to FIG. 4, the compressed air tank 74 is mounted within the hopper-like portion 38 of the attachment 10 to abut the attachment's forwardmost side 80 between the left side 100 of the attachment 10 and the plastic elbow 48. The fluid reservoir 76 is mounted within the second, rearwardly extending portion 40 of the attachment 10 to abut the left side (not shown), forwardmost side 82, the upper side 84 of the protrusion 41 in the second portion 40. The air compressor 72 is also mounted in the protrusion 41 to abut the protrusion's forwardmost side 82 between the air compressor 72 and the right side (not shown) of the protrusion 41. The pressure switch 78, which controls the operation of the compressor 72, is attached to a three-way connector 83, which is connected a second way to a check valve 71, which is, in turn, connected to the air compressor 72 on the side of the compressor 72 opposite the forwardmost side 82 of the protrusion 41.

Continuing to refer to FIG. 4, the spray nozzles 68 and 70 (68 not shown in FIG. 4) are each mounted in their respective brackets 86 and 87 (86 not shown), which are both bolted to the inside of the leading side 85 of the shroud 98. Each of the spray nozzles 68 (not shown in FIG. 4) and 70 are mounted in the brackets 86 (not shown) and 87 so that the spray from each is directed downward toward the surface of the carpet 44 through the shroud 98 and skirt 99 in the attachment's second portion 40.

As noted above, two, two-inch Marshalltown pressure gauges 91 and 92 are mounted in the right rear side 90 of the second portion 40. The first gauge 91 is a 0–100 P.S.I. gauge, and the second gauge 92, mounted four to five inches below the first gauge 91, is a 0–15 P.S.I. gauge. A Shrader, No. 5421, adjustable air regulator 93 is connected to the second gauge 92 within the perifery of second portion 40 of the attachment 14. The Shrader regulator 93 is, in turn, connected the second way to a three-way Mini-Qwick connector 94, which is connected the second way to a 105 P.S.I. pressure relief valve 95 and the third way to a second three-way connector 118. The second three-way connector 118 is connected the second way to the second pressure gauge 91 and the third way through an air line 113 (not shown in FIG. 4) to, as shown in FIG. 5, a mechanical air valve 105.

Referring back to FIG. 4, the fluid reservoir 76 in the second portion 40 of the attachment 14 has, on its right face 88, a 10 P.S.I. air receptacle 75 near the uppermost circumferential edge of the reservoir 76. Also on the reservoir's right face 88 is a fluid outlet 77 near the lowermost circumferential edge of the right face on the reservoir 76.

The air tank 74 in the hopper-like portion 38 of the attachment 14 has an air inlet 79 and an air outlet 82 on the right face 89 of the air tank 74. The inlet 79 and outlet 82 are somewhat diametrically opposed to one another and are both located at a distance of about one inch from the outermost circumferential edge of the right face 89 on the air tank 74.

Figure 5:
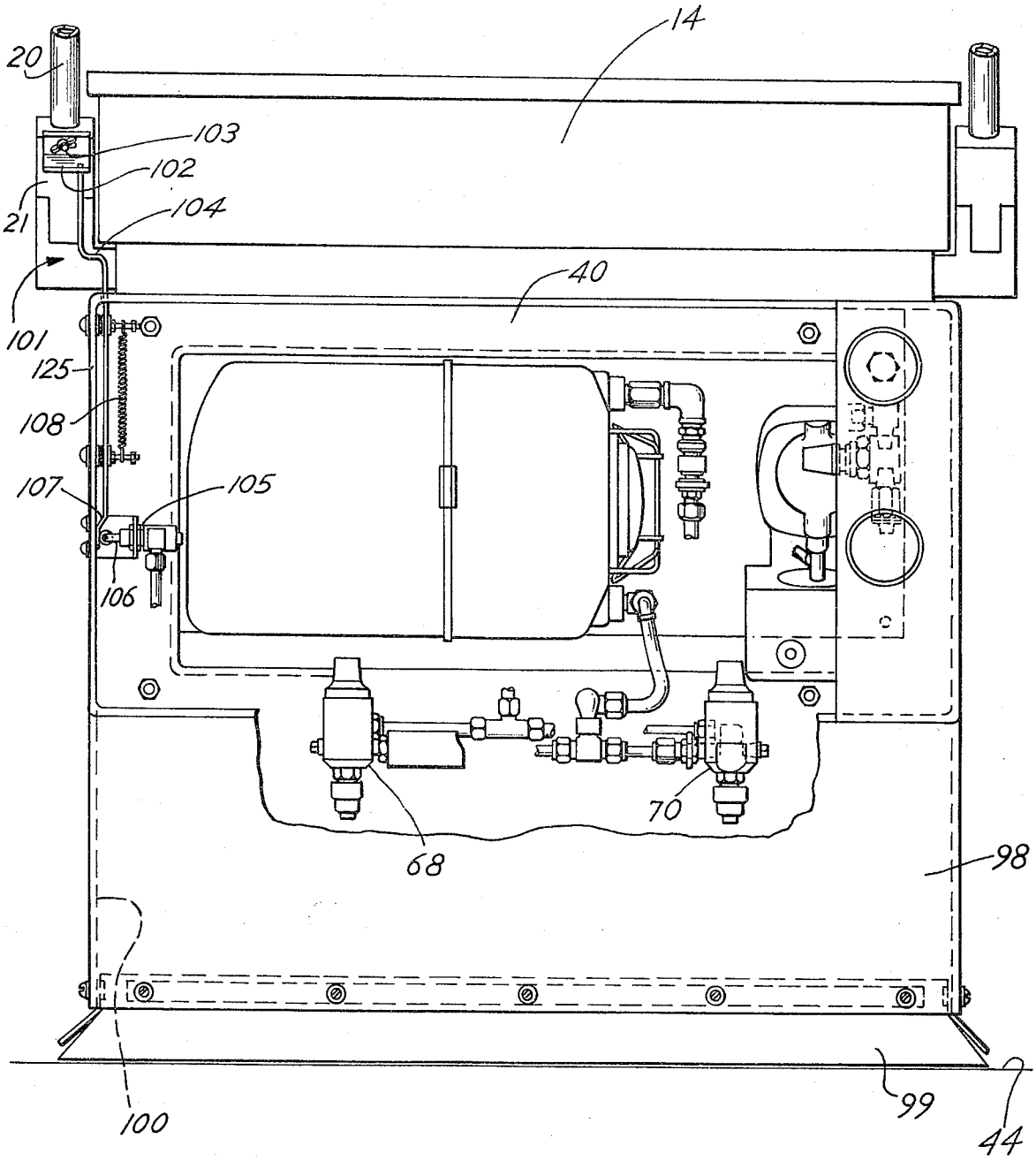
FIG. 5 is a detailed, cross-sectional rear plan view through a removed portion of the rear side of the removable spraying attachment, further showing the location of the nozzles, the fluid reservoir, the switches, and portions of the gas source within the housing.

Referring now to FIG. 5, the left nozzle 68 is spaced horizontally to the left of the right nozzle 70 at a distance sufficient to generate a substantially uniform spray over the path of travel of the carpet vacuum 14. The shroud 98 and skirt 99 completely surround the spray area of the nozzles 68 and 70 so that the spray from the nozzles 68 and 70 is confined to a specific portion of the surface 44 being sanitized.

On the far left side of the attachment's second portion 40, there is a spray actuator, generally 101. As shown with more specificity in FIGS. 6 and 7, the actuator 101 is comprised essentially of (1) a horizontally slidable bracket 102 firmly attached by means of a wing screw 103 to a vertically movable portion 21 on the left side of the carpet vacuum's handle 20, (2) a vertically slidable actuator arm 104 passing through an aperture 130 located vertically below the bracket 102 in the top side 67 of the attachment's second portion 40, (3) a 100 P.S.I. mechanical air valve 105 bolted to the left side 125 of the attachment's second portion 40 so that a switching toggle 106 in the valve 105 lies in the path of travel of the switching angle 107 on the lower part of the arm 104, and (4) a vertically oriented return spring 108 bolted on the upper end 120 to the leftside 125 of the attachment's second portion 40 and on the lower end 121 to the actuator arm 104.

Figure 7:
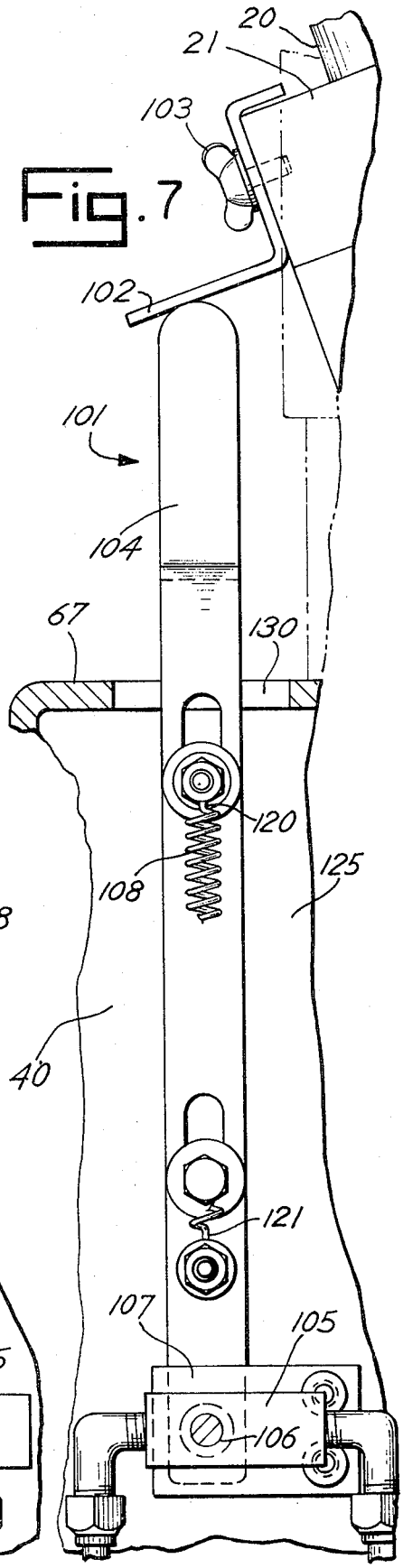
FIG. 7 is a partial, detailed, and enlarged cross-sectional plan view through the right side of the removable attachment, showing the right view of the spraying actuator.

Referring to the schematic diagram in FIG. 7, a first air line 110 connects the check valve 71, which is connected to the air outlet 73 on the air compressor 72, to the air inlet 79 on the air tank 74, and a second air line 111 connects the air outlet 81 on the air tank 74 to the pressure relief valve 95. Hence, compressed air from the air compressor is stored in the air tank 74 and subsequently delivered to the pressure relief valve 95 as needed.

Figure 6:
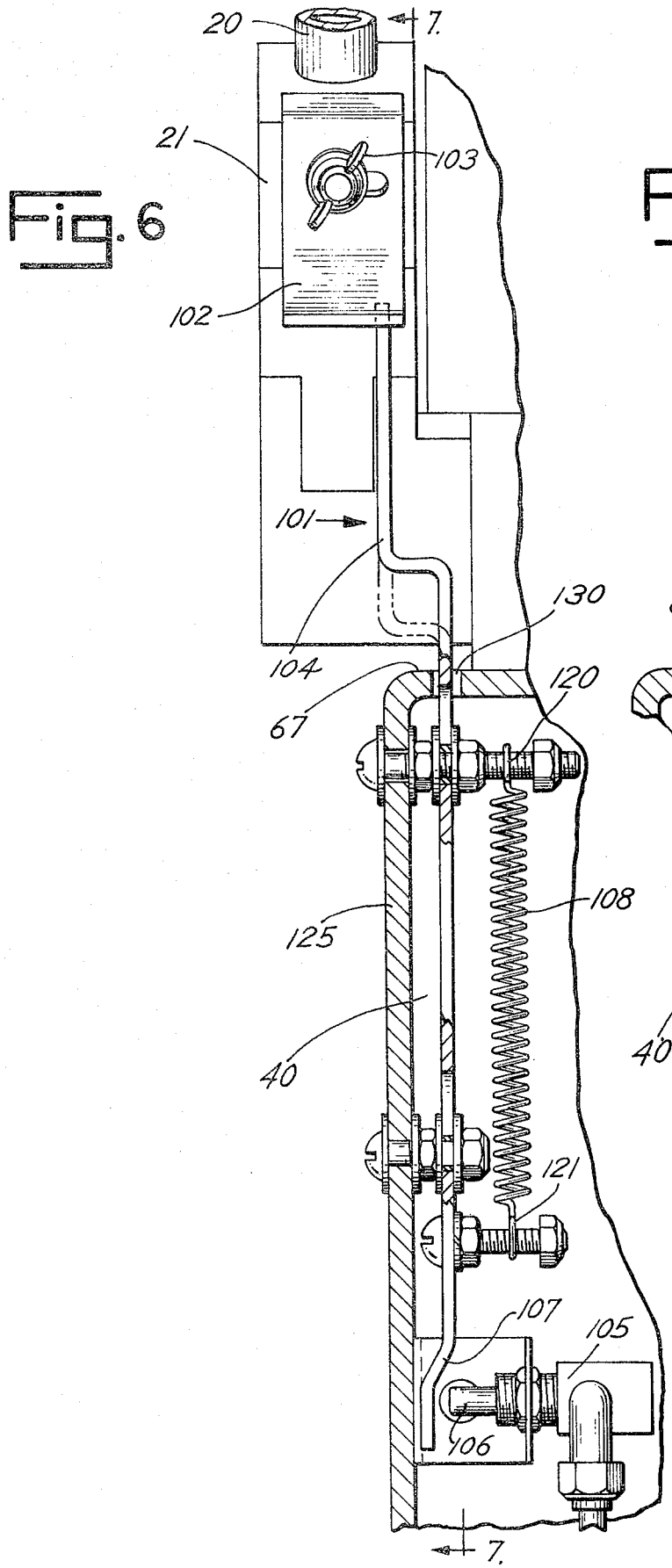
FIG. 6 is a partial, detailed, and enlarged cross-sectional plan view through the rear side of the spraying attachment, showing the rear view of the spraying actuator that automatically starts and stops the spraying action of the attachment.

Compressed air delivered to the pressure relief valve 95 then passes from the pressure relief valve 95 to the three-way Mini-Qwick connector 94. From the Mini-Qwick connector 94, compressed air originating from the air tank 74 then passes to both the adjustable regulator 93 and the second three-way connector 118, both of which are connected directly to the Mini-Qwick connector 94. A third air line 112 connecting the first outlet 128 on the second three-way connector 118 to the first air gauge 91, delivers air originating from the air tank 74 to the first gauge 91 to provide an indication of air pressure in the air tank 74. A fourth air line 113, connecting the second outlet 129 on the second three-way connector 118 to the mechanical air valve 105, delivers compressed air originating from the air tank 74 to the air valve 105. A fifth air line 114, connecting the air valve 105 to the nozzles 68 and 70, delivers compressed air from the air tank 74 to the nozzles 68 and 70 when the mechanical air valve 105 is in the open position (which it is when, as shown in FIG. 6, the operator's handle 20 is depressed to force the actuator arm 104 to engage and move downward the switching toggle 106).

Compressed air from the air tank 74, delivered through the Mini-Qwick connector 94 to the regulator 93, travels through the adjustable air regulator 93, which steps down the pressure of the air to a maximum of 10 P.S.I. From the regulator 93, the 10 P.S.I. air then passes into both a sixth air line 115 and the second pressure gauge 92. The sixth air line 115, connecting the regulator 93 to the air receptacle 75 on the fluid reservoir 76, then delivers air at a maximum of 10 P.S.I. to the air receptacle 75 while the first pressure gauge 91 indicates the air pressure in the sixth air line 115 and fluid reservoir 76.

Fluid from the fluid reservoir 76 is delivered to both nozzles 68 and 70 by means of a fluid line 116 that connects the fluid outlet 77 on the reservoir 76 to both nozzles 68 and 70. The nozzles 68 and 70 each contain valves (not shown) within them that shut off fluid flow through the valves 68 and 70 when the air pressure in the fifth air line 114 drops below 30 P.S.I. and open up fluid flow when that air pressure rises above 30 P.S.I.

Power supplying wires 117 and 119, electrically connecting the power plug 64 on the attachment 10 to the pressure switch 78, provide electrical power to the compressor 72 from the carpet vacuum 14 (not shown). The pressure switch 78 stops the flow of electrical power to the air compressor 72, however, when the air pressure in the first air line 110 rises above 98 P.S.I. and turns on the flow of electrical power when the air pressure in the first air line 110 drops below 70 P.S.I.

Figure 8:
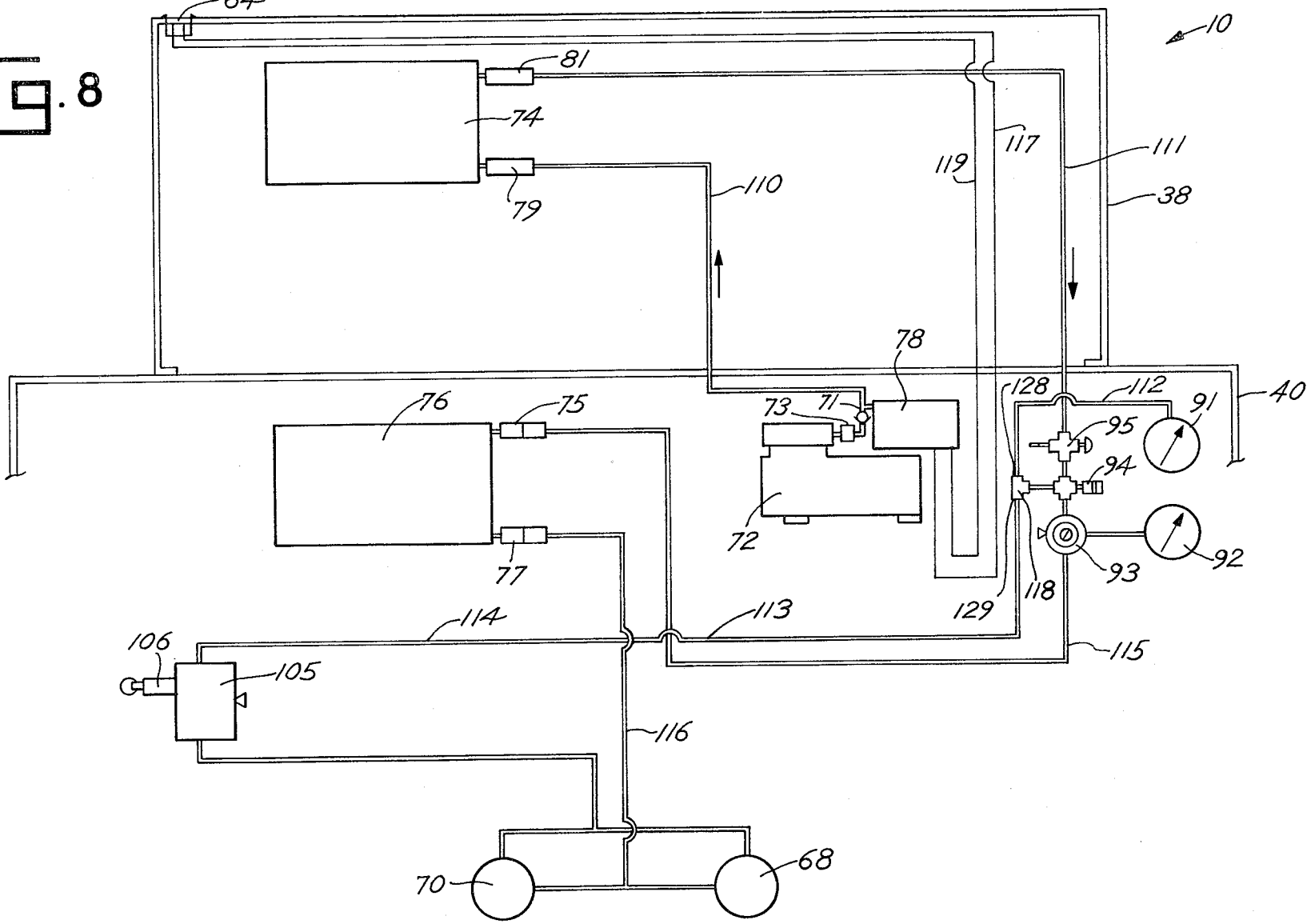
FIG. 8 is a schematic view showing the interconnection of the various working components of the preferred embodiment of the fluid spraying attachment.

Now referring back to FIG. 5, the actuator arm 104 trips the switching toggle 106 on the mechanical air valve 105 when the handle 20 and the bracket 102 of the BOVAC carpet vacuum 14 are moved downward against the actuator arm 104. When the switching toggle 106 is depressed by the switching angle 107 on the actuator arm 104, the pressure of the air in the sixth air line 115, as shown in FIG. 8, rises above 30 P.S.I., and the nozzles 68 and 70 (as shown in FIG. 5) therefore begin to spray a fluid and gas spray. Still referring to FIG. 5, the nozzles 68 and 70 continue to spray until the operator allows the handle 20 to move upward. When the handle 20 moves upward, the actuator arm 104 also moves upward against bracket 102 as a result of the upward pressure on the arm 104 generated by the return spring 108. When the actuator arm 104 moves upward (thereby moving the switching angle 107 on the arm 104 upward), the switching toggle 106 moves upward, shutting off the flow of compressed air from the air tank 74 to the nozzles 68 and 70, which in turn shut off the flow of fluid as a result of the decreased air pressure. Hence, the preferred embodiment of the sanitizer attachment 10 is fully automatic along with the BOVAC carpet vacuum 14, providing a sanitizing spray behind and in the path of travel of the carpet vacuum 14 only when the handle 20 is depressed by the operator for intended automatic vacuuming and sanitizing.

By loosening the wing screw 103 on the bracket 102, the bracket 102 can be horizontally moved so that the bracket 102 will not contact the actuator arm 104 when the handle 20 is moved downward. As a result, the BOVAC carpet vacuum 14 can also be operated with the spraying attachment 10 mounted on it without the spraying mode provided by the attachment 10.

In the preferred embodiment as shown in FIG. 2, the sanitizer housing for both portions 38 and 40 is made of a durable, rigid plastic, such as polyethylene. The skirt 99 is made of a more flexible plastic such as polyurethane. In addition, the fluid contained in the reservoir 76, as shown in FIG. 3, is SaniMaster Solution mixed with tap water and detergent.

While in the foregoing, there has been provided a detailed description of one particular embodiment of the present invention, it is to be understood that all equivalents obvious to those having skill in the art are to be included within the scope of invention as claimed. Moreover, while the foregoing preferred embodiment is designed to be used in conjunction with the ServiceMaster BOVAC hospital carpet vacuum, the present invention also encompasses the use of the invention disclosed herein on other vacuum cleaners, floor sweepers, or other floor cleaning devices.

What is claimed is:

1. In a mobile vehicle floor cleaner, the improvement comprising an apparatus for spraying a fluid on a floor, said apparatus comprising:

(a) a spray nozzle rigidly mounted on the floor cleaner and directed toward the floor behind the floor cleaner;

(b) a fluid reservoir fixed to the floor cleaner;

(c) a fluid line connecting the fluid reservoir to the spray nozzle;

(d) a housing having an upper end and an open lower end opposite the upper end and nearest the floor, the housing being rigidly secured to the floor cleaner, surrounding the spray nozzle, and terminating at the lower end in a shroud for confining the spray from the spray nozzle to a predetermined portion of the floor behind and substantially in the path of the floor cleaner as the floor cleaner advances; and (e) means for forcing fluid from the fluid reservoir through the spray nozzle.

2. The improved mobile floor cleaner of claim 1 wherein the forcing means (e) comprises a source of pressurized gas connected to the fluid reservoir and the spray nozzle.

3. The improved mobile floor cleaner of claim 1 or 2 wherein the lower end of the shroud includes a flexible skirt extending downwardly toward the floor and providing a barrier to confine the spray from the spray nozzle to the predetermined area of the floor.

4. The improved mobile floor cleaner of claim 2 wherein the source of pressurized gas includes means for supplying pressurized gas, a gas supply line from the supplying means to a central connector, a first conduit from the central connector to the spray nozzle, a second conduit from the central connector to the fluid reservoir, and a pressure regulator in the second conduit.

5. The improved mobile floor cleaner of claim 4 wherein the improvement also includes gas control means for increasing or decreasing the pressure of the gas delivered to the spray nozzle by the first conduit, and liquid valve control means for starting the fluid spraying action of the spray nozzle when the pressure delivered by the first conduit rises above a predetermined value and stopping the spraying action when the pressure drops below a predetermined value, the air control means and liquid valve control means being fixed to the mobile floor cleaner.

6. The improved mobile floor cleaner of claim 1 or 2 wherein the improvement also includes liquid control means for stopping and starting the forcing means and thereby stopping and starting the spraying action of the spray nozzle.

7. The improved mobile floor cleaner of claim 1, 2, 4, or 5, wherein (i) the mobile floor cleaner includes a vacuum device for transporting debris from a surface into an air stream, (ii) the spraying apparatus includes a first filter attached to the housing, and (iii) the housing is removably attachable to the floor cleaner and includes means for directing the air stream to the first filter.

8. The improved mobile floor cleaner of claim 7 wherein the mobile floor cleaner includes a second filter and the spraying apparatus also includes second means for receiving the air stream from the first filter and directing the air stream to the second filter, the first filter defining a trap for larger debris in the air stream and the second filter defining a trap for smaller debris in the air stream.

9. The improved mobile floor cleaner of claim 7 wherein the mobile floor cleaner includes a plurality of filters in series and the spraying apparatus also includes second means for receiving the air stream from the first filter and directing the air stream to the plurality of filters, the first filter providing a trap for larger debris in the air stream and said plurality of filters providing a trap for smaller debris in the air stream.

10. In an improved mobile floor cleaner of the type that has a forward and a rearward end and that includes (i) a vacuum cleaner for delivering debris gathered from a floor-like surface to an air stream, (ii) at least one cleaner filter, and (iii) a rearwardly extending handle for guiding the floor cleaner, the improvement comprising, in combination:

(a) a spray nozzle rigidly mounted on the floor cleaner below the handle and directed downwardly toward the floor behind the floor cleaner, the spray nozzle providing means for combining fluid and gas and generating a fluid and gas spray;

(b) a fluid reservoir mounted in the housing and including a receptacle for the receipt of pressurized gas;

(c) a fluid line connecting the fluid reservoir to the spray nozzle;

(d) a housing having an upper end nearest the handle and a lower end adjacent the floor, the housing being rigidly secured to the rearward end of the floor cleaner, surrounding the spray nozzle, and terminating at the lower end in a shroud including a flexible skirt abutting the floor, the shroud providing means for confining the spray from the spray nozzle to a predetermined portion of the floor behind and substantially in the path of the floor cleaner as the floor cleaner advances;

(e) a pressurized gas source including means for supplying pressurized gas, a central connector, a supply line for delivering gas from the supply means to the central connector, a first conduit for delivering gas from the central connector to the spray nozzle, a second conduit for delivering gas from the central connector to the fluid reservoir, and a pressure regulator for regulating the pressure of the gas delivered by the second conduit to the reservoir;

gas control means for increasing or decreasing the pressure of the gas delivered to the spray nozzle by the first conduit;

liquid valve control means for starting the fluid and gas spraying action of the spray nozzle when the pressure of the gas delivered by the first conduit rises above a predetermined value and stopping the spraying action when the pressure drops below a predetermined value;

an attachment filter attached to the housing;

first receiving means for receiving the air stream from the vacuum cleaner and delivering the air stream to the attachment filter; and second receiving means for receiving the air stream from the attachment filter and delivering the air stream to the cleaner filter.

* * * * *